United States Patent [19]

Schoch

[11] 4,034,259

[45] July 5, 1977

[54] SPARE LAMP CONTROL CIRCUIT FOR A LIGHT PROJECTION SYSTEM

[75] Inventor: David K. Schoch, Downers Grove, Ill.

[73] Assignee: Audio Visual Innovators Corporation, Darien, Ill.

[22] Filed: Apr. 14, 1976

[21] Appl. No.: 676,747

[52] U.S. Cl. ..... 315/93; 240/37.1; 307/39; 315/88; 315/90

[51] Int. Cl.[2] ..... H05B 37/04

[58] Field of Search ..... 315/88–91, 315/93; 240/37.1; 307/39, 131; 352/198

[56] References Cited

UNITED STATES PATENTS

| | | | |
|---|---|---|---|
| 2,197,700 | 4/1940 | MacGregor | 315/93 X |
| 3,809,917 | 5/1974 | Vore | 307/39 |

*Primary Examiner*—Eugene La Roche
*Attorney, Agent, or Firm*—McWilliams & Mann

[57] ABSTRACT

A control circuit for a light projection system for energizing a spare lamp when the circuit detects failure of a main lamp. A pair of input lines apply an alternating-current voltage source to the circuit, to the main lamp and to a spare lamp which is substantially in parallel connection with the main lamp. A switch is in series connection with the main and spare lamp for selectively energizing one of the lamps. Current sensing means, generally a resistor, in series connection with the switch and the lamps, senses the current through the main lamp thereby dropping a small portion of the voltage source. A pair of opposite polarity voltage references are established by rectifying the voltage dropped across the current sensing resistor and by rectifying the voltage across the input lines of the voltage source. A tracking voltage reference, proportionally tracks voltage variations on one of the input lines to distinguish between operation of the system at reduced voltages and failure of the main lamp, and is provided by summing and dividing the voltages of the opposite polarity voltage references. A voltage comparator monitors the voltage reference, and has an output adapted to control the switch. Failure of the main lamp causes the voltage across the current sensing resistor to collapse, thereby causing the tracking voltage reference to differ significantly from the potential on one of the input lines, further causing the voltage comparator to change its output and the switch to change position such that the spare lamp is energized. The output of the voltage comparator generally controls an electromechanical device for changing positions of the switch. A second switch, in series with the circuit between the input lines, is controlled by the electromechanical device. The second switch assumes an open state after the first switch energizes the spare lamp, thereby interrupting energization of the electromechanical device and the circuit.

9 Claims, 3 Drawing Figures

SPARE LAMP CONTROL CIRCUIT FOR A LIGHT PROJECTION SYSTEM

BACKGROUND OF THE INVENTION

This invention relates in general to a control circuit for a light projection system, and more particularly to a control circuit wherein a voltage comparator compares the potential on one of a pair of input lines to a voltage reference generated by the circuit such that the circuit is capable of detecting failure of a main lamp and automatically energizing a spare lamp and is further capable of distinguishing between failure of the main lamp and operation of the projection system at reduced input voltages.

Various types electrically, mechanically and thermally activated devices are known in the prior art for energizing a spare lamp in a light projection system upon failure of the main lamp. Many of the mechanically and thermally activated devices are unsuitable for commercially used light projection systems because of the length of time taken between failure of the main lamp and energization of the spare lamp. Especially in commercial usage of light projection systems, such as presentations before large or important audiences including sales or marketing conferences, training sessions, conventions and the like, rapid sensing of the failure of the main lamp and energization of the spare lamp are required to avoid annoyance and inconvenience to everyone involved.

Prior art controls, including circuits, also suffer from the inability to distinguish between failure of the main lamp and operation of the main lamp at reduced voltages. In those control systems which employ circuitry, the circuitry is generally operated from direct current voltage sources, requiring expensive and inefficient means to isolate the alternating current voltage source generally associated with projection systems from direct current voltage source required for the circuitry. Motors, transformers, photoelectric devices and thermal sensors are typical of these isolation techniques.

SUMMARY OF THE INVENTION

The control circuit of the present invention operates directly from the alternating-current voltage source generally provided in and to a light projection system. A pair of input lines apply the alternating-current voltage source to the circuit. A main lamp and a spare lamp, substantially in parallel connection with the main lamp, are in series connection with a switch for selectively energizing either the main lamp or the spare lamp across the input lines. Current sensing means, generally a resistor of low resistive value, is also in series connection with the lamps for sensing the current through the main lamp and for dropping a small portion of the voltage source thereacross.

A first rectification means associated with the current sensing resistor estabishes a first voltage reference by rectification of the portion of the line votage dropped across the current sensing resistor. A second recification means provides a second voltage reference by rectifying the voltage appearing across the input lines such that the polarity of the second voltage reference with respect to one of the input lines is opposite to that of the first voltage reference. Voltage summing and dividing means are connected between the opposite polarity voltage references to provide a tracking voltage reference which will track the potential on one of the input lines despite variations in the potential of the voltage source. A voltage comparator monitors the voltage differences between one of the input lines and the tracking voltage reference.

Failure of the main lamp interrupts current through the current sensing resistor, causing the first voltage reference to collapse. As this occurs, the tracking voltage reference also assumes a different potential from that of the input line which it is tracking, causing the voltage comparator to change in output. The output of the voltage comparator is adapted to control an electromechanical device for changing the position of the switch, thereby energizing the spare lamp for continued light projection. Because the voltage references are established by rectification of the alternating current input voltage, or a portion thereof, the voltage references will change proportionally with any variation in the potential of the alternating current voltage source. Therefore the tracking voltage reference also changes proportionally, which enables the tracking voltage reference to follow variations in the alternating current voltage source.

Such a tracking phenomena is important in enabling the circuit to distinguish between failure of the main lamp and operation of the projection system at reduced input voltage level. Many commercial applications of light projectors include operating sequences wherein the projectors are alternatively switched on and off, or where their superimposed images are dissolved by operating of the projectors through a range of input voltages such that the projector lamp operates at a range of voltages other than its nominal voltage.

A second switch is located in series with the circuit between the pair of input lines and is normally closed while the main lamp is functioning. This second switch is also controlled by the electromechanical device. After the main lamp fails, the circuit energizes the electromechanical device to begin operation of the spare lamp, at which time the electromechanical device also opens the second switch. Opening of the second switch disables the control circuit; the operation of which is no longer required after the spare lamp has been energized upon failure of the main lamp.

Various other objects, features and advantages of the invention will become apparent from the following detailed disclosure when taken in conjunction with the drawings.

DESCRIPTION OF THE PREFERRED EMBODIMENTS

Figure 1:
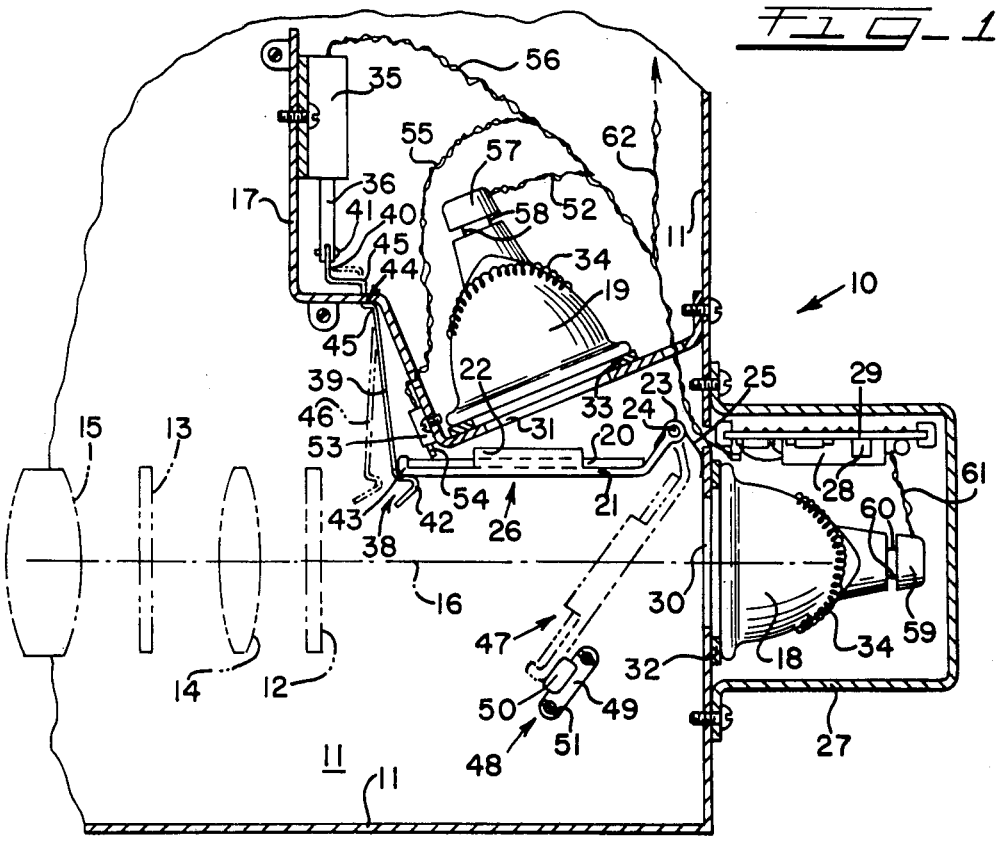
FIG. 1 is a plan view, partially in section, of the interior of a portion of a light projection system illustrating the lamp and optical arrangement of the invention.

Turning to FIG. 1, there is shown a portion of the interior of a light projection system in plan view. FIG. 1 is partly in section and illustrates a light projection system, generally designated 10, which is particularly useful in a slide projector.

Many other components, beside those illustrated in FIG. 1, are employed in a typical light projection system used in a slide projector. Such components include a motor for ventilating heat from the interior of the projector and actuating means for a slide changing mechanism. However these additional components are not necessary for an appreciation and understanding of the invention herein.

The projector, generally designated 10, of FIG. 1 has a frame 11 suitable for securing various internal components thereto. A heat absorbing glass 12 is usually located on the lamp side of a slide 13. A condensing lens 14 is interposed between the slide 13 and the heat absorbing glass 12 and condenses illumination from a light source. A focusing lens 15 is located on the opposite side of the slide 13 and is usually movable through a limited distance for focusing the image presented by the illuminated slide upon a screen (not shown) or the like. A common optical axis 16 is shared by the focusing lens 15 and the condensing lens 14.

A web 17 generally meanders through the interior of the projector thereby subdividing the interior of the projector 10 into various compartments. These various compartments are usually designed for best light transmission, heat ventilation and the like. Such considerations are beyond the scope of this invention. However the web 17 is useful for mounting various components required by the invention.

According to one aspect of the invention, there is provide a main lamp 18 fixedly mounted with respect to the frame 11 on the optical axis 16 of the lenses 14, 15. Also fixedly mounted with respect to the frame 11, at a position off of the optical axis 16, is a spare lamp 19. As shown in FIG. 1, the spare lamp 19 is at oblique angle with respect to the optical axis 16. Both of the lamps 18, 19 preferably have highly directional light patterns for optimum light transmitting efficiency. A reflecting mirror 20 is positionable between two positions as illustrated in FIG. 1. In the first position, shown in dark lines and generally designated 26, the mirror does not obstruct light transmission between the main lamp and the projection lenses 14, 15. In the second position, shown in the lighter lines in FIG. 1 and generally designated 47, the mirror is in position to reflect light from the spare lamp 19 along the optical axis 16 of the projection lenses 14, 15. A mirror holder 21 supports the mirror 20 and pivots the mirror 20 between its first and second positions 26, 47, respectively. The mirror holder 21 has tabs 22 at the top and bottom edges thereof bent or rolled through 180 degrees to define a channel in which the mirror 20 is secured. One vertical edge 23 of the mirror support 21 is pivotally secured with respect to the frame 11. One means of accomplishing the pivoting relationship is to have the horizontal edge 23 bent to define a cylindrical aperture therealong. A post 24 fixedly attached with respect to the frame pivotally secures the end 23 of the mirror support 21 to the frame 11. The post 24 is located away from the optical axis 16 such that light from the main lamp 18 is not obstructed. Resilient biasing means 25, resiliently biases the mirror 20 from the first position thereof to the second position thereof. The biasing means 25 is typically a coil spring wrapped about the post 24, with one end of the means 25 cooperating with the frame 11 to urge the mirror 20 and the mirror support 21 toward the second position 47 thereof.

To enable both of the lamps 18, 19 to be located the same optical distance from the condensing lens 14, the main lamp 18 is preferably located within a housing 27 fixedly attached to the rear of the projector 10. It is understood that the front of the projector 10 is commonly the side of the projector 10 nearest to the focusing lens 15. Also located within the housing 27 is sensing means for detecting the failure of the main lamp 18. The sensing means consist of a number of electrical circuit elements 28 mounted on a circuit board 29, with the circuit board 29 fixedly secured within the housing 27.

The lamps 18, 19 are a high brilliancy type which generally have a relatively short life-span. These lamps 18, 19 have self-contained reflectors for providing light with a highly directional light pattern.

To facilitate light transmission from the main lamp 18 along the optical axis 16, a window area 30 is provided in the frame 11 about the axis 16. Another window area 31 is provided in the web 17 to allow light transmission from the spare lamp 19. Between the main lamp 18 and the frame 11 may be interposed a shock absorbing material 32. The material 32 is generally a gasket capable of withstanding high temperatures at which the main lamp 18 will operate. Shock absorbing material 33, similar to that of the material 32, may be interposed between the spare lamp and the web 17. Both of the lamps 18, 19 are secured against the shock absorbing material 32, 33 by resilient means 34. Examples of the resilient means 34 include elongated coil springs or wires which exhibit spring tension.

An electromechanical device 35, with a plunger 36 movable with respect to the device 35, is fixed in relation to the frame 11 and is preferably affixed to the web 17. The plunger 36 operates releasable securing means, generally designated 38, for the mirror holder 21, permitting the mirror 20 to assume its second position 47 when resiliently biased thereto. The electromechanical device 35 and the plunger 36 comprise the actuation means for the releasable securing means 38. The releasable securing means 38 typically comprises a lever 39 with one end 40 thereof secured to an end 41 of the plunger 36. Another end 42 of the lever 39 is hook-shaped to engage another vertical edge 43 of the mirror support 21 in the first position 26 thereof. Intermediate the ends 40, 42 of the lever 39 is a point 44 of the lever. The point 44 is attached to the web 17 in a fulcrum or pivotable fashion. One means of achieving the fulcrum or pivotable relation between the lever 39 and the web 17 is to have the lever 39 pass through an aperture in a web 17, with the lever 39 having the series of bends 45 near the point 44 such that the lever 39 cannot move about its length with respect to the web 17 but can only pivot with respect to the web 17 at the point 44. When the electromechanical device 35 is energized, causing the plunger 36 to move into the device 35, the lever 39 will assume the dotted position 46 thereof, thereby releasing the mirror support 21 and the mirror to assume the second position 47 thereof.

A mirror stop means 48 is fixedly attached in relationship to the frame 11 and is located to limit movement of the mirror support 21 to the second position 47 thereof. The mirror stop means 48 has a base plate 49 attached to the frame 11 with a shock absorbing portion 50 projecting upwardly from the base plate 49. The shock absorbing portion 50 stops the mirror support 21 upon reaching the second position thereof in an essentially vibration-free manner. The base plate 49 of the stop means 48 may employ slots 51 therein to permit adjustment of the mirror stop means 48 to permit fine adjustment of the reflected light from the spare lamp 19 along the optical axis 16.

A switch 53 is fixedly mounted to the web 17 at a location near the first position of the mirror 20. A pin 54 projects from the switch 53 for sensing whether the mirror 20 is in the first position 26 thereof, with the mirror 20 urging the pin 54 into the switch 53. The switch 53 is electrically connected to the circuit board 29, the main lamp 18 and the spare lamp 19 by a plurality of leads 55 in a manner which will be hereinafter explained.

It will be appreciated that the electromechanical device 35 controls the state of switch 53 because of the mechanical interconnection from the plunger 36, to the releasable securing means 38, to the mirror support 21, to the mirror 20, and finally to the pin 54 of the switch 53. When the main lamp 18 fails and the current sensing means energizes the electromechanical device 35 causing the mirror securing means 38 to assume the second position 46 thereof, the pin 54 of the switch 53 will be released as the mirror 20 begins to move toward its second position 47, thereby switching the state of the switch 53 as the mirror 20 begins to leave the first position 26 thereof. Thus the spare lamp 19 is immediately energized and the spare lamp 19 begins to increase in illumination intensity toward full brilliancy as the mirror 20 assumes the second position 47 thereof. Because the transition of the mirror 20 from its first position 26 to its second position 47 requires only a fraction of a second and the spare lamp 19 is increasing in illumination intensity during this period, light projection along the optical axis 16 is substantially uninterrupted by failure of the main lamp 18. The main lamp 18 does not stop providing light exactly at the instant in which failure thereof occurs, but continues providing light in decreasing intensity as the filament thereof cools toward lower temperatures. Thus, light overlap between the burned-out main lamp 18 and the newly energized spare lamp 19 further aid in continuity of projected light.

Figure 2:
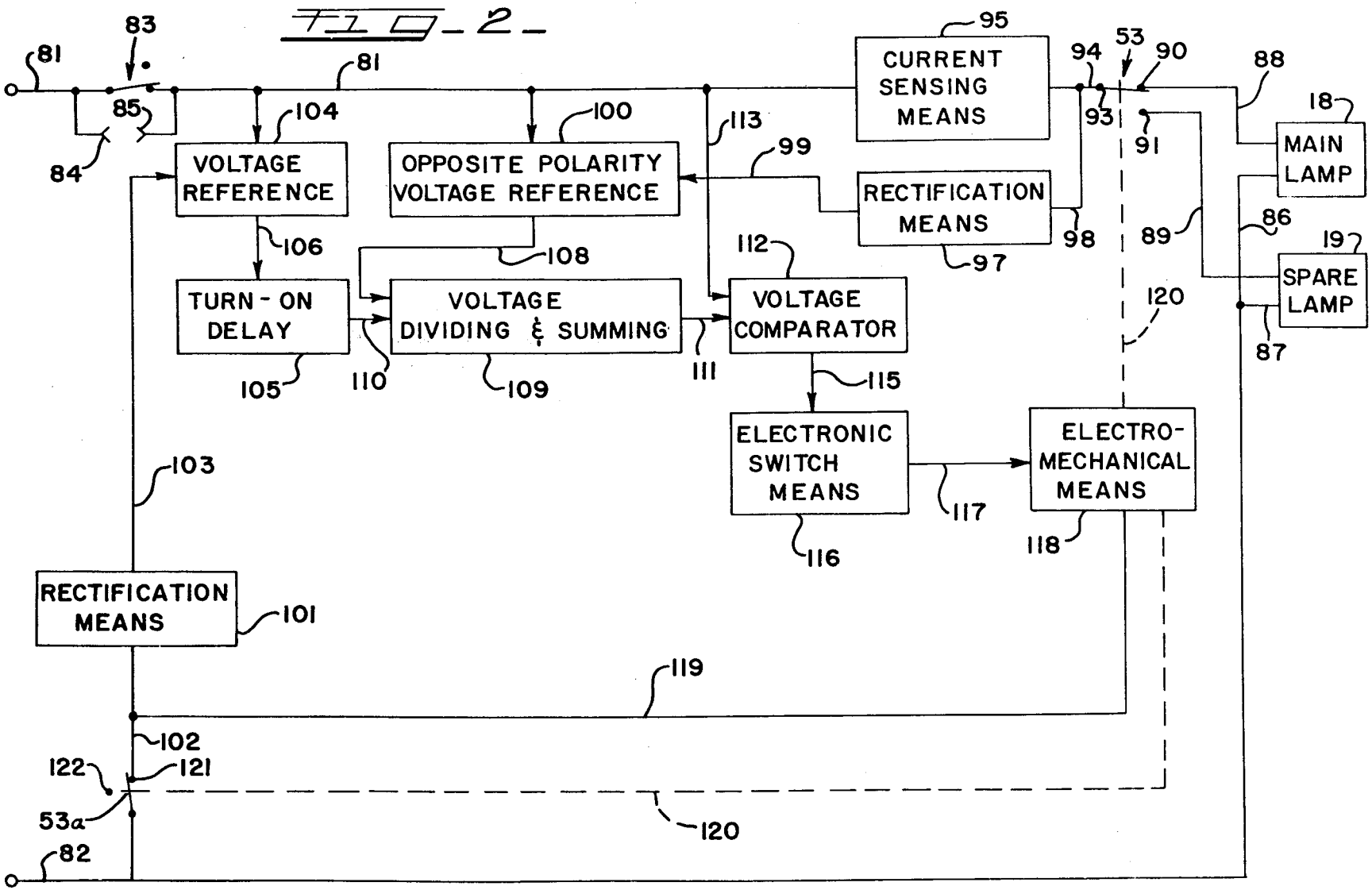
FIG. 2 is a block diagram of the control circuit of the invention, functionally illustrating the operation thereof.

Various other electrical interconnections are made in FIG. 1. A pair of leads 56 connect the electromechanical device 35 through the circuit board 29. Electrical connection between the spare lamp 19 and the circuit board 29 is accomplished by means of a socket 57 connecting to a pair of leads 58 of the spare lamp 19, with a pair of wires 52 interconnecting the socket 57 with the circuit board 29. Similarly, a socket 59 connects to the leads 60 of the main lamp 18, with a pair of wires 61 electrically connecting the socket 59 to the circuit board 29. A plurality of other leads 62 electrically connect the lamps 18, 19, circuit board 29, switch 53 and electromechanical device to the alternating-current voltage source, power switch 83 and a current sensing resistor 96. The need for leads 62 and their significance will become apparent when FIGS. 2 and 3 are considered hereinafter.

The above description of the lamp system has been on a piecemeal basis. It is now appropriate to consider the overall function and advantages of the lamp system. Both the main lamp 18 and the spare lamp 19 are preferably located at approximately equal optical distances from the condensing lens 14. A typical optical distance would be about 9 centimeters. The main lamp 18 is located directly in line with the optical axis 16 for maximum light transmission. It is known to those skilled in the art that use of any reflecting device results in about 15 to 20% of light loss due to light scattering, reflecting losses, improper adjustment of the reflecting device and the like. However after failure of the main lamp, such losses can be tolerated with respect to spare lamp 10 until nonuse of the projection system allows sufficient time for replacement of the main lamp 18. When the projector 10 is partially disassembled for replacement of the burned-out main lamp 18, the mirror 20 is manually reset into the first position 26 by pushing it from the second position 47 back into the first position 26. The hook-shaped end 42 of the securing means 38 engages the vertical edge 43 of the mirror support 21 to retain the mirror 20 in the first position 26. As will be hereinafter explained, the electromechanical device 35 moves the securing means 38 to the releasing positions 46 for only a brief interval after failure of the main lamp 18. Thus, the securing means 38 is able to again retain the mirror in the first position 26 whenever it is convenient to replace the main lamp 18 and manually reset the mirror 20. It is important that the reflecting mirror 20 and the associated mirror support 21 are located in a position off of the axis 16 such that light from the main lamp 18 is not obstructed in any manner during operation of the main lamp 18. Also the mirror 20 must pivot from its first position 26 to its second position 47 at a point remote from the axis 16 such that light transmission from the main lamp 18 is not interfered with. The mirror support 21 is preferably fabricated from material with low mass properties, such as aluminum. Mirror 20 is preferably as thin as possible to keep the mass thereof at a minimum. Preferably, the combined mass of the mirror 20 and the support 21 is less than 3 ounces. The low masses of the mirror 20 and the mirror support 21 further aid in keeping vibration caused by transition of the mirror 20 and the support 21 from the first position 26 to the second position 47 at a minimum. Because the projector 10 is typically located some distance from the screen upon which the enlarged image of the slide 13 is projected, any small movement of the projector 10 about the optical axis 16 translates into a sizeable displacement of the enlarged image on the screen. Such displacement is particularly undesirable in presentations before large audiences where the images of a plurality of projectors are superimposed on the screen and where a portion of the projected image is off of the screen.

Slide projectors which are suitable for practicing the invention taught herein are commercially available from the Eastman Kodak Company of Rochester, N.Y. and are identified by that Company as Ektagraphic Models B-2 and E-2.

Figure 3:
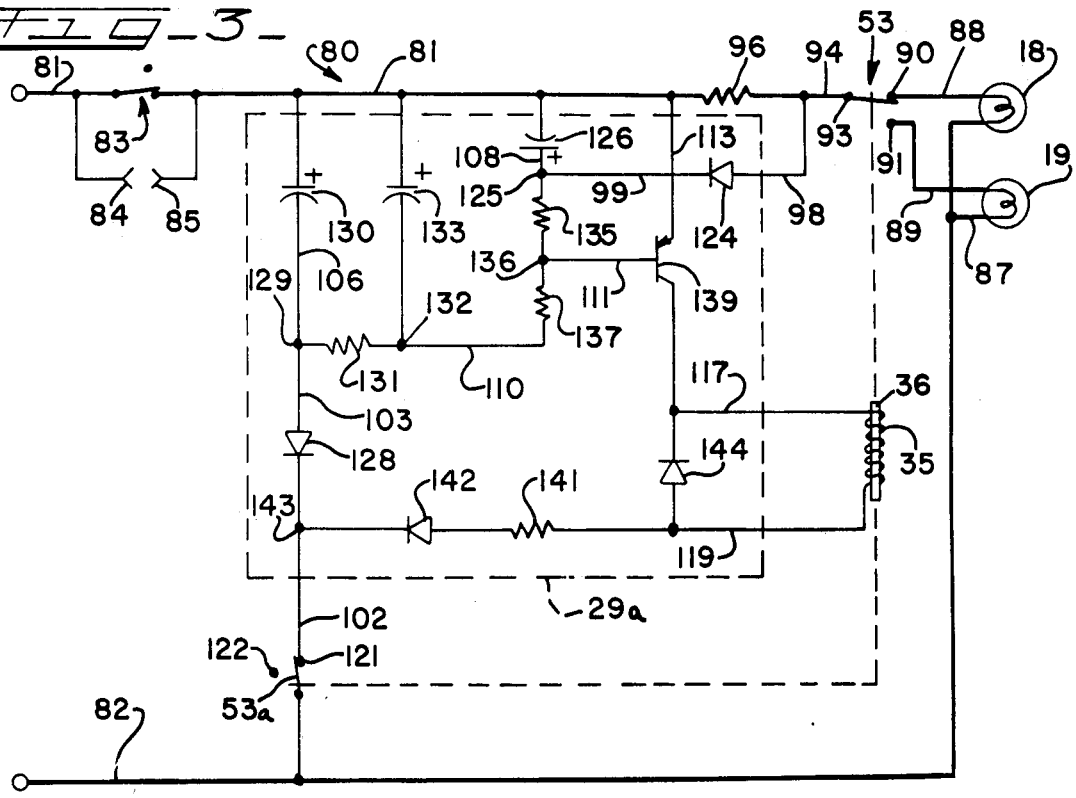
FIG. 3 is a schematic diagram of the control circuit for sensing the failure of the main lamp and automatically switching to the spare lamp of the projection system.

A control circuit, generally designated 80, for detecting the failure of the main lamp 18 is illustrated in FIG. 3. To better facilitate understanding of the operation of the circuit 80, a block diagram of the circuit is illustrated in FIG. 2.

With reference to FIG. 2 there are provided a pair of input lines, including a line 81 and a line 82, for applying an alternating-current voltage source to the circuit 80. A manually-operated power switch 83 is operable between on and off positions to control application of the voltage source to the circuit 80. The switch 83 is usually provided with most projectors by the manufacturers thereof. In addition, most projectors suitable for commercial purposes include a pair of jacks 84, 85 in electrically parallel connection with the switch 83. The jacks 84, 85 provide capability to control the main lamp 18 or the spare lamp 19 from a remote source. Remote source controls could include dimming devices to control the illumination intensity of the main lamp 18 or the spare lamp 19, such as when dissolving from the image provided from one projector to the image provided by another projector. In more sophisticated applications the jacks 84, 85 enable control of a plurality of projectors by programmable computers for automated and creative presentations.

The main lamp 18 and the spare lamp 19 are wired in substantially parallel connection. A lead 86 from the main lamp 18 and a lead 87 from the spare lamp 19 are connected to the input line 82. A lead 88 from the main lamp 18 and a lead 89 from the spare lamp 19 are connected to contacts 90, 91, respectively, of the switch 53. As previously discussed, the switch 53 is usually held closed relative to the contact 90 when the mirror 20 is in the first position 26 thereof, as illustrated by the dark lines in FIG. 1. The switch 53 will open from contact 90 and close with respect to contact 91 as the mirror 20 is released from its first position 26.

Another terminal 93 (FIG. 2) of the switch 53 is connected by a lead 94 to the current sensing means 95 for the main lamp 18. The current sensing means 95 is in series between one of the input lines 81 and the lead 94. Typically the current sensing means comprises a resistor 96 (FIG. 3) of low ohmic value. The current sensing resistor 96 is found in many projectors, not employing the invention herein, to limit the inrush current to the main lamp 18 when the voltage source is first applied thereto by closing the power switch 83. The resistor 96 also functions to drop a small portion of the input voltage source thereacross, as compared to the voltage dropped by the main lamp 18 or the spare lamp 19, thereby operating the lamp 18 or the spare lamp 19, at a slightly reduced voltage from that of its nominal voltage rating. Operation of such lamps at a slightly reduced voltage level is known to prolong their operative life span.

With the basic wiring of a projector employing a spare lamp 19 in mind, fundamental operation of the circuit 80 may be understood by considering the block diagram of FIG. 2. According to another aspect of the invention, rectification means 97 is connected by a lead 98 to the lead 95 for rectifying the small portion of the alternating-current voltage source dropped across the current sensing means 95. A lead 99 from the rectification means 97 establishes a voltage reference 100 between the lead 99 and the input line 81. A second rectification means 101 rectifies the voltage appearing across the input lines 81, 82 to establish a second voltage reference 104 which is opposite in polarity with respect to the input line 81 to the voltage reference 100. The second rectification means 101 is connected by lead 102 through a second switch **53*a* to the input line 82, and by lead 103 to the second voltage reference 104. Because the rectification means 97, 101 rectify alternating-current voltages, the first voltage reference 100 and the second voltage reference 104 are both direct-current potentials. Furthermore, these potentials are both referenced to the input line 81 and float with respect thereto despite any alternating-current voltage variation in the line 81**.

The second voltage reference 104 is presented to a turn-on delay 105 through a lead 106. Both the first voltage reference 100 and an output of the turn-on delay 105 are presented to a voltage summing and dividing means 109 by a lead 108 and a lead 110, respectively. The voltage summing and dividing means 109 sum and proportion the potentials of the voltage references 100, 104 on the leads 108, 110 to provide a tracking voltage reference at an output lead 111 of the voltage summing and dividing means 109. As long as both the first voltage reference 100 and the second voltage reference 104 are operative, the tracking voltage reference appearing on the lead 111 will be approximately equal in potential to the potential appearing on the input lead 81. A voltage comparator 112 compares the potential of the tracking voltage reference on the lead 111 to the potential on the input line 81. A lead 113 references the voltage comparator 112 to the line 81.

As is known in the lamb art, failure of a lamp is characterized by an open filament thereof. Thus, failure of the main lamp 18 will provide an open circuit to the current sensing means 95 resulting in no main lamp current therethrough. Cessation of current through the current sensing means 95 causes that portion of the voltage source dropped thereacross to vanish, resulting in no alternating-current voltage for the rectification means 97 to rectify. Thus, the first voltage reference 100 collapses. The second voltage reference 104 is then able to directly influence the tracking voltage appearing at the lead 111, causing said tracking voltage reference to change in potential with respect to the line 81. The change in potential between the lead 111 and the line 81 cause the voltage comparator 112 to change in output on a lead 115 thereby causing an electronic switch means 116 to also change its conduction state. Change in conduction state of the electronic switch means 116 on a lead 117 causes an electromechanical means 118 to change in energization state. The electromechanical means 118 is mechanically coupled, as indicated at 120, to the switch 53 and to a second switch **53*a*. The second switch 53*a* is physically a part of the switch 53 and the operation and significance thereof are hereinafter described. Change in energization of the electromechanical means 118 causes the switch 53 to change from the position illustrated in FIG. 2 to electrically connect the terminal 93 with the contact 91 thereby energizing the spare lamp 19. The electromechanical means 118 is referenced to the input line 82 by a lead 119**.

The turn-on delay 105 is interposed between the second voltage reference 104 and the voltage summing and dividing means 109 to allow potential from the first voltage reference 100 on the lead 108 to rise faster than the potential from the second voltage reference 104 on the lead 110 when power is first spplied to the circuit 80. The difference in potential rise times on the leads 108, 110 keeps the tracking voltage reference on the lead 111 near the potential on the input line 81 to avoid having the voltage comparator 112 inadvertently detect the difference between the tracking voltage reference on the lead 112 and the potential on the input line 81 as indicative of the failure of the main lamp 18 when the voltage source is first applied to the circuit 80 by closing the power switch 83. It will be readily appreciated by those skilled in the art that the need for any turn-on delay 105, and whether such delay 105 is required with respect to the second voltage reference 104 or the first voltage reference 100, depends upon the characteristics of the voltage comparator 112 and the respective rise times of the first voltage reference 100 and the second voltage reference 104. Because the control circuit 80 is operated directly from an alternating-current voltage source and it is generally not known whether input line 81 will be positive or negative with respect to input line 82 at the instant in which power is first applied to the circuit 80, it is possible that some delay will have to be associated with one of the voltage references 100, 104 to avoid a turn-on hazard in the voltage comparator 112.

After the main lamp 18 has failed and the circuit 80 has caused the switch 53 to close against the contact 91 thereby energizing the spare lamp 19, current through the current sensing means 95 will cause the circuit 80 to again assume a monitoring mode wherein the electromechanical means 118 assumes the prior energization state. From an energy consumption standpoint, it is preferably to have the electromechanical means 118 de-energized while the circuit 80 is in a monitoring mode and to have the electromechanical means 118 energized for the brief instant after which the main lamp 18 has failed but the switch 53 has not yet changed position from the contact 90 to the contact 91. However since circuit 80 has completed its function when it has caused the switch 53 to change positions such that the spare lamp 19 is energized, further energy consumption considerations make it preferable to interrupt the functioning of the circuit 80. For this purpose, the switch 53 preferably has another pair of contacts 121, 122 with the contact 121 in series with the circuit 80 between the input lines 81, 82. These separate contacts 121, 122 comprise the second switch **53*a*. The switch 53*a* is normally closed against the contact 121 to allow operation of the circuit 80. When the main lamp 18 fails and the circuit 80 causes the switch 53 to change position in response to the electromechanical means 118 as previously described, the switch 53*a* opens against the contact 122 thereby interrupting and rendering inoperative the control circuit 80. Thus, further energy consumption in, and biasing of, the circuit 80** are avoided.

Turning now to FIG. 3, the current sensing resistor 96 drops several volts of alternating-current voltage thereacross during operation of the main lamp 18. A rectifying diode 124 has an anode terminal connected through the lead 98 and the lead 94 to one terminal of the current sensing resistor 96. The cathode terminal of the diode 124 is connected through the lead 99 to the terminal 125. A capacitor 126 is connected between the junction 125 and the line 81 on the other side of the resistor 96. The diode 124 half-wave rectifies the alternating-current voltage appearing across the resistor 96 during that portion of the cycle in which the lead 94 is positive with respect to the line 81, in a peak-charging manner. A first voltage reference is thereby established across the capacitor 126.

A second rectifying diode 128 has a cathode terminal referenced to the input line 82 by lead 102 through the switch **53*a*. The anode terminal of the diode 128 is connected by lead 103 to a junction 129. A capacitor 130 is connected between the input line 81 and the junction 129. The diode 128 half-wave rectifies the voltage source between the input lines 81, 82 to establish a second voltage reference across the capacitor 130, in a peak-charging manner. It will be appreciated that because of the manner in which the diodes 124, 128 are poled, the second voltage reference across the capacitor 126, and both capacitors 126, 130 are referenced to the input line 81**.

Also connected to the junction 129 is a resistor 131 with the other terminal thereof connected to another junction 132. A capacitor 133 is connected between the junction 132 and the input line 81. The values of the resistor 131 and the capacitor 132 are selected to provide a relatively large resistive-capacitive time-constant with respect to the operating frequency of the voltage source. Thus, when the voltage source is first applied to the circuit 80 by closing the power switch 83 the potential at the junction at 132 with respect to the line 81 will rise considerably slower than the potential at the junction 129.

A resistor 135 is connected between the junction 125 and another junction 136. Another resistor 137 is connected between the junction 136 and the junction 132. The resistors 135, 137 serve to sum and proportion the first voltage reference appearing at terminal 125 and the delayed second voltage reference appearing at the terminal 132 to thereby provide a tracking voltage reference at the junction 136, and at the lead 111 connected to the junction 136.

A transistor 139 has a base terminal thereof connected by the lead 111 to the junction 136 and an emitter terminal thereof connected through the lead 113 to the input line 81. Transistor 139 is of the PNP type. The tracking voltage reference established by the voltage summing and dividing resistors 135, 137 on the lead 111 will keep the transistor 139 in a non-conductive state if the tracking voltage reference is approximately equal to the potential appearing at the line 81. However, it is preferable to select the values of the voltage summing and dividing resistors 135, 137 such that the tracking voltage reference on the lead 111 is a couple volts positive with respect to potential appearing on the line 81 to avoid the transistor 139 from being rendered conductive because of electrical noise in the circuit 80.

When the main lamp 18 fails and current ceases to flow in the current sensing resistor 96, no voltage drop will appear across the current sensing resistor 96 and the diode 124 will no longer peak-charge the capacitor 126. Thus, the first voltage reference appearing at the junction 125 will begin to drop below the potential of line 81 as the capacitor 126 discharges through the resistors 135, 137, 131. As this discharge of capacitor 136 continues, a point in time will be reached at which the emitter-base junction of the transistor 139 becomes foward biased. At this time, the transistor 139 is rendered conductive. Thus, the emitter-base junction of the transistor 139 behaves as a voltage comparator in comparing the tracking voltage reference on the line 111 to the potential on the input line 81.

A collector terminal of the transistor 139 is connected by lead 117 to an electromechanical device 35, with said device having a movable plunger 36 mechanically adapted to change the position of switch 53 and the switch **53*a*. Another terminal of the device 35 is connected by a lead to a resistor 141. The other terminal of the resistor 141 is connected to an anode terminal of a diode 142, with a cathode terminal thereof connected to the lead 102 at a junction 143. Another diode 144 is connected between the leads 117, 119, in parallel with the electromechanical device 35. The diode 144 is poled such that a cathode terminal thereof is connected to the collector terminal of the transistor 139 and to the lead 117, with the anode terminal thereof connected to the lead 119 and the resistor 141. The diode 142 is poled such that an anode terminal thereof is connected to the resistor 141 and the cathode terminal thereof is connected to the junction 143. The diode 142 serves to prevent conduction of the transistor 139 during those portions fo the alternating-current cycle in which the line 82 is positive with respect to the line 81 and also serves to prevent reverse voltage breakdown of the transistor 139 during said portions of the alternating-current cycle. Besides functioning as a voltage comparator, the transistor 139 behaves as an electronic switch in applying the voltage source across the lines 81, 82 to the electromechanical device 35, the resistor 141 and the diode 142. It will be readily appreciated by those skilled in the art however that the transistor 139 could behave as a voltage comparator alone with the collector terminal thereof driving a separate semiconductor (not shown) or switch means (not shown), with the separate semiconductor or switch means controlling energization of the electromechanical device 35**.

When transistor 139 is rendered conductive, the electromechanical device 35 is energized causing the plunger 36 to move and the switch 53 to change position from the contact 90 to the contact 91. During energization of the device 35, the resistor 141 limits the maximum current which can pass through the windings of the device 35 to a suitable level. The diode 144 is normally non-functioning or is reverse biased. When the transistor 139 again returns to its non-conductive state, the diode 144 provides an inductive current path for the device 35 as the device 35 de-energizes. The diode 144 limits the negative voltage across the device 35 to a forward-biased diode drop and thereby avoids having the device 35 place a large negative inductive voltage spike on the collector terminal of the transistor 139.

When the transistor 139 energized the electromechanical device 35, switch **53*a* was caused to move from contact 121 to contact 122 to open the switch 53*a*, thereby de-energizing the electromechanical device 35. The device 35 is energized only for the brief interval necessary to change position in switches 53, 53*a*. Opening of the switch 53*a* also interrupts normal biasing of the circuit 80 and further avoids placement of a large negative voltage on the capacitor 126. The capacitor 126 is preferably of an electrolytic, polarized type which cannot withstand large negative voltages thereacross. Normal biasing current for the circuit 80** is in the range of a couple millamperes.

All of the electrical circuit elements within the dashed line **29*a* in FIG. 3 are suitable for mounting upon the circuit board 29 in FIG. 1**.

Typical component values and ratings for the various circuit elements in FIG. 3, with the circuit 80 operating from a 120 volt source, are as follows;

| | |
|---|---|
| Diode 124 | 1N4002 |
| Diode 128 | 1N4006 |
| Diode 142 | 1N4006 |
| Diode 144 | 1N4006 |
| Capacitor 126 | 25 micro-farads, 15 volts |
| Capacitor 130 | 1 micro-farad, 200 volts |
| Capacitor 133 | 5 micro-farads, 150 volts |
| Resistor 96 | 5 ohms, 30 watts, wire-wound |
| Resistor 131 | 47 kilo-ohms |
| Resistor 137 | 22 kilo-ohms |
| Resistor 135 | 3.9 kilo-ohms |
| Transistor 139 | 2N5416 |
| Electromechanical device 35 | Solenoid, 24 volts drop-out, intermittent duty, 81 ohms |
| Lamps 18, 19 | Type ELH |

As previously discussed, light projection systems used in commercial applications are frequently operated at less than nominal voltages, especially when used in fading and dissolving modes of operation. It is therefore extremely important that any means of detecting failure of the main lamp 18 be capable of distinguishing between operation of the circuit 80 at reduced voltage source levels and between failure of the main lamp 18. The control circuit 80 is capable of performing this function. As the voltage source appearing across the input lines 81, 82 is decreased, less current passes through the main lamp 18 and through the current sensing resistor 96 such that the portion of the voltage source dropped across the current sensing resistor 96 also decreases. This further causes a corresponding decrease in the level of the first voltage reference appearing across the capacitor 126 because the diode 124 has a lower level of alternating-current voltage to half-wave rectify. Similarily, the second voltage reference appearing across the capacitor 130 decreases in potential in direct correspondence to the decrease in the voltage source appearing across the lines 81, 82. Because the tracking voltage reference appearing at lead 111 is obtained by summing and dividing the first and second voltage references, any descrease in the first and second voltage references proportionally affects the potential of the tracking voltage reference. Thus, proper selection of the resistors at the lead 111 to track any voltage variation in the potential of the voltage source across the input lines 81,82. As further previously discussed, failure of the main lamp 18 causes collapse of the first voltage reference appearing across the capacitor 126 because the capacitor 126 discharges through the resistors 135, 137, 131 when a portion of the voltage source dropped across the current sensing resistor 96 is interrupted by failure of the main lamp 18. Thus the circuit 80 is capable of distinguishing between operation of the main lamp 18 at reduced voltage source levels and between failure of the main lamp 18.

It will be understood that various changes and modifications may be made without departing from the spirit of the invention as defined in the following claims, and equivalents thereof.

I claim:

1. A control circuit for a light projection system for operation from an alternating-current voltage source, said circuit comprising:

a pair of input lines for applying said alternating current voltage source to said circuit;

a main lamp;

a spare lamp substantially in parallel connection with said main lamp;

switch means in series connection with said main lamp and said spare lamp for selectively energizing said main lamp or said spare lamp across said pair of input lines;

current sensing means in series connection with said switch means for sensing current through said main lamp and for dropping a portion of the voltage source thereacross;

rectification means;

a voltage reference established by said rectification means rectifying said portion of the voltage source dropped across said current sensing means;

voltage comparator means for comparing the voltage difference between a pair of inputs, one of said inputs referenced to one of said input lines, another of said inputs for monitoring said voltage reference, said voltage comparator means having an output responsive to said pair of inputs and adapted to control said switch means, whereby failure of said main lamp causes said portion of the voltage source dropped across said current sensing means to be removed therefrom, causing said voltage reference to collapse and said voltage comparator means to change said output, said switch means responding to the changed output to said voltage comparator means to energize said spare lamp.

2. A control circuit as in claim 1 wherein said voltage comparator means controls the state of said switch means by energizing an electromechanical device upon the failure of said main lamp causing said voltage reference to collapse, said electromechanical device having mechanical interconnection to said switch means to cause said switch means to change state and energize said spare lamp upon energization of said electromechanical device.

3. A control circuit for a light projecting system for operation from an alternating current voltage source, said circuit comprising:

a pair of input lines for applying said alternating current voltage source to said circuit;

a main lamp;

a spare lamp substantially in parallel connection with said main lamp;

switch means in series connection with said main lamp and said spare lamp for selectively energizing said main lamp or said spare lamp across said pair of input lines;

current sensing means in series connection with said switch means for sensing current through said main lamp and for dropping a portion of the voltage source thereacross;

first rectification means;

a first voltage reference established by said rectification means rectifying said portion of the voltage source dropped across said current sensing means;

second rectification means;

a second voltage reference connected in series with said second rectification means across said pair of input lines, said second rectification means poled such that said second voltage reference is opposite in polarity to said first voltage reference;

voltage summing and dividing means connected between said first voltage reference and said second voltage reference whereby said voltage summing and dividing means provides a tracking voltage reference which will track the voltage on one of said input lines when said voltage source is varied in potential;

voltage comparator means for comparing the voltage difference between a pair of inputs, one of said inputs referenced to one of said input lines, another of said inputs for monitoring said tracking voltage reference, said voltage comparator means having an output responsive to said pair of inputs and adapted to control said switch means, whereby said voltage comparator means distinguishes between operation of said circuit at varied potentials of said voltage source and between failure of said main lamp, failure of said main lamp causing said portion of the voltage source dropped across said current sensing means to be removed therefrom, causing said first voltage reference to collapse and said voltage comparator means to change said output, said switch means responding to the changed output of said voltage comparator means to energize said spare lamp.

4. The control circuit as in claim 3 wherein said current sensing means comprises a resistor, said first voltage reference is established across a capacitor with one terminal of said capacitor connected to one terminal of said resistor, and said first rectification means comprises a diode connected between another terminal of said resistor and another terminal of the capacitor, said diode half-wave rectifying the portion of the voltage source dropped across said resistor.

5. The circuit as in claim 3 further comprising delay means interposed between said second voltage reference and said voltage summing and dividing means to cause said tracking voltage reference to follow said first voltage reference when said voltage source is first applied to said circuit.

6. The circuit as in claim 5 wherein said delay means comprises a resistor in series between said second voltage reference and said voltage summing and dividing means; and a capacitor between said voltage summing and dividing means and one of said input lines.

7. The circuit as in claim 6 wherein said voltage comparator means comprises a transistor with an emitter connected to one of said input lines, a base connected to said tracking voltage reference; and collector connected to an electromechanical device, said electromechanical device controlling said switch means.

8. The circuit as in claim 7 further comprising second switch means responsive to the position of the switch means for selectively energizing said main lamp or said spare lamp; said second switch means being connected in series between another of said pair of input lines, and said second rectification means and said electromechanical device; said second switch means being in a closed state during operation of said main lamp, said second switch means assuming an open state shortly after said switch means energizes said spare lamp to interrupt energization of said electromechanical device and said second rectification means.

9. The control circuit as in claim 5 wherein said light projecting system is of the type which includes a light reflection means pivotable between a first position and a second position for allowing direct light transmission from said main lamp to a projecting lens when said reflecting means is in said first position, and for reflecting light from said spare lamp to said projecting lens after failure of said main lamp when said reflecting means is in said second position, said switch means furthermore sensing whether said reflecting means is in said first position, said switch means energizing said spare lamp as said reflecting means leaves said first position such that said spare lamp increases in illumination intensity as said reflecting means pivots to said second position whereby said light projection system is substantially uninterrupted by failure of said main lamp.

* * * * *